United States Patent [19]

Bischoff

[11] Patent Number: 4,947,573

[45] Date of Patent: Aug. 14, 1990

[54] GUN STOCK MITTEN

[76] Inventor: Eric Bischoff, 4225 E. 182nd St., Prior Lake, Minn. 55372

[21] Appl. No.: 395,662

[22] Filed: Aug. 18, 1989

[51] Int. Cl.[5] ..... F41C 27/00; A41D 13/10

[52] U.S. Cl. ..... 42/106; 2/161 A

[58] Field of Search ..... 42/106, 96, 94, 74; 2/94, 161 A, 160

[56] References Cited

U.S. PATENT DOCUMENTS

| | | | |
|---|---|---|---|
| 3,167,875 | 2/1965 | Winner et al. | 42/106 |
| 3,368,811 | 2/1968 | Finney | 42/106 |
| 4,120,108 | 10/1978 | Vickers et al. | 42/74 |
| 4,644,987 | 2/1987 | Kiang | 42/74 |
| 4,712,253 | 12/1987 | Chen | 2/161 A |
| 4,741,052 | 5/1988 | Rubin | 2/161 A |

FOREIGN PATENT DOCUMENTS

| | | | |
|---|---|---|---|
| 235290 | 10/1910 | Fed. Rep. of Germany | 42/96 |

*Primary Examiner*—Charles T. Jordan
*Assistant Examiner*—Michael J. Carone
*Attorney, Agent, or Firm*—Palmatier & Sjoquist

[57] ABSTRACT

A gun stock sleeve with a mitten for use in adverse weather conditions by persons carrying rifles, shotguns or like firearms or guns having a stock is provided. The gun stock mitten includes a gun stock sleeve and a removably attached mitten. The sleeve is adjustable to fit tightly over the gun stock to permit carrying of the gun while the hand is in the mitten. The mitten and sleeve arrangement permits quick withdrawal from the mitten, without assistance of the hand used for grasping of the trigger, sighting and shooting the gun without interference by the gun stock mitten and its sleeve.

7 Claims, 3 Drawing Sheets

GUN STOCK MITTEN

FIELD OF THE INVENTION

This invention relates generally to hand coverings for use while undertaking recreational activities and, more particularly, to a gun stock sleeve with a mitten removably attached to a gun stock that warms or protects the hand that will be used to operate the trigger of the gun. The mitten allows facile and quick removal of the hand from the mitten to permit grasping of the trigger to fire the gun. While firing, the mitten remains attached to the gun stock sleeve so that the hand may conveniently be replaced therein.

BACKGROUND OF THE INVENTION

In the prior art, there are many mittens, and/or glove-type, hand coverings available to protect the wearers' hands from adverse conditions. U.S. Pat. Nos. 4,698,851; 4,653,121; 3,885,249; 2,089,086; 3,203,005; and 4,727,675 describe hand coverings for use in various activities ranging from various work activities to skiing, fishing or other recreational activities.

For protection of the hands while hunting, U.S. Pat. No. 4,754,498 (to Stinemates) describes an enclosure that is intended for use with a shotgun or rifle. The body is a bifurcated unit made up of a pair of angularly related sleeves. The sleeves meet in the area of the trigger, enclosing the trigger, for access to the shooter's hand and fingers to the trigger area.

A problem with this prior art hand covering protection is that it may interfere with activities undertaken while wearing the hand covering. A specific problem for hunters active in cold weather is that such hand protection, either in glove or mitten form, may interfere with operating the safety mechanism and firing a gun. Although the Stinemates patent and the other prior art referred to above represent advances in the art of protection of hands from cold weather while undertaking various activities, there are several specific needs of hunters which have remained unaddressed.

A first, and very important, need, concerning safety, is that a user must be able to visually observe the trigger, cocking and safety mechanisms of the weapon being used. A second need is that it is crucial that the firearm user's line of sight along the top of the weapon and to the target remain unimpaired. Another need, particularly while engaged in hunting or skeet-type target shooting, is that it is important that the user be able to react to the presence of a target and, while protected from cold weather, still be able to quickly grasp and pull the trigger of the weapon. Additionally, it is important that the person using a firearm be able to set the weapon down with a minimum of inconvenience, still having the hands protected from cold.

SUMMARY OF THE INVENTION

The needs outlined above are in large part addressed and met by the gun stock sleeve with a mitten in accordance with the present invention. A gun stock sleeve with a mitten for use in adverse weather conditions by persons carrying rifles, shotguns or like firearms or guns having a stock is provided. The gun stock sleeve with mitten includes a gun shoulder stock and/or fore end sleeve and at least one mitten removably attached to the sleeve. The sleeve is adjustable to fit tightly over the gun stock to permit carrying of the gun while the hand is in the mitten. The mitten and sleeve arrangement permits quick withdrawal from the mitten, without assistance, of the hand used for grasping of the trigger, sighting and shooting the gun without interference by the gun stock mitten and its sleeve. At least a portion of the sleeve and mitten are made from a Velcro®, hook/loop type or other quickly releasably interlocking material or fabric.

It is a primary object of the present invention to provide a simple inexpensive hand covering method that permits a hunter or user to readily hold and carry a gun while protecting the user's hands from cold or adverse weather while yet permitting quick withdrawal of the hand from the mitten, without assistance of the other hand as the other hand lifts the gun, and while the mitten remains attached to the sleeve, grasping of the trigger, sighting and shooting the gun without interference by the gun stock mitten and its sleeve.

It is another object of the present invention to provide a gun stock mitten which permits the wearer to hold and carry a firearm in a convenient "port-arms" position with the trigger hand being kept warm by the mitten and which quickly permits the user to remove the hand from the mitten and grasp the trigger.

Another object of the present invention is to make sure that the trigger and safety mechanism is visible to the hunter and not covered by the mitten or sleeve.

It is yet another object of the present invention to provide a gun stock mitten which is adapted for use by both right and left-handed persons with no structural modifications of the mitten required.

An additional object of the present invention is to provide a gun stock mitten which may be used with different size gun stocks.

Another object of the present invention is to provide a gun stock mitten which minimizes possible weapon sighting interference and which minimizes any possible interference or entanglement with the mitten when reaching for and grasping a trigger mechanism.

Yet another object of the present invention is to provide a gun stock mitten wherein the hand covering or mitten is removably attached to the gun stock so that, if necessary, the weapon or gun can be set down and the user's hand may be kept warm without the necessity of carrying additional hand coverings.

These and other objects of the present invention are achieved by providing a gun stock mitten which includes a Velcro® type fabric band or sleeve, elastic or non-elastic, which fits over the shoulder stock and/or fore-end of a weapon and a hand covering which is removably fastened to the stock band by a similar, complementary Velcro® or releasably interactive-type material.

Other objects or advantages of the present invention will be understood with reference to the following specification and to the appended drawings and claims.

DETAILED SPECIFICATION

Figure 1:
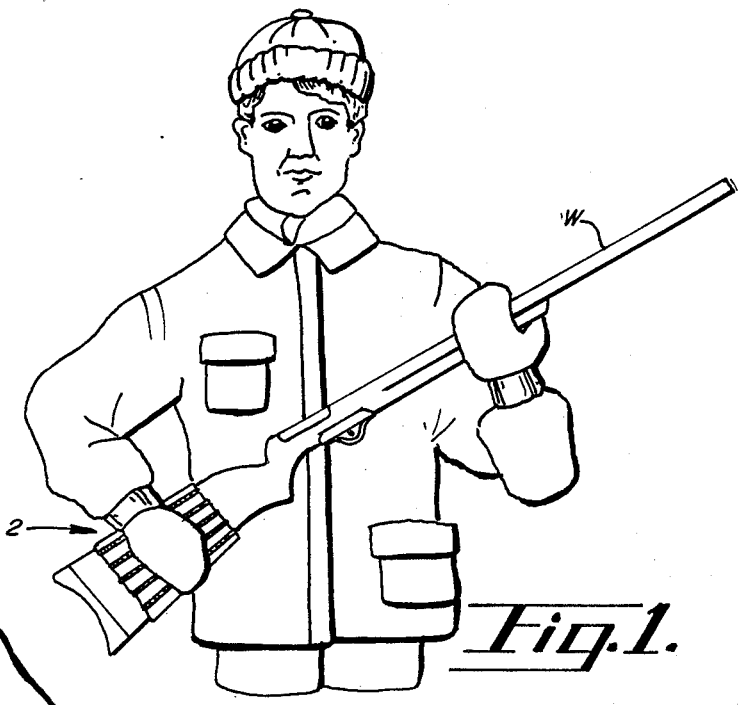
FIG. 1 is a pictorial illustration of an individual using the gun stock sleeve with mitten of the present invention and carrying a weapon at "port-arms"
Figure 2:
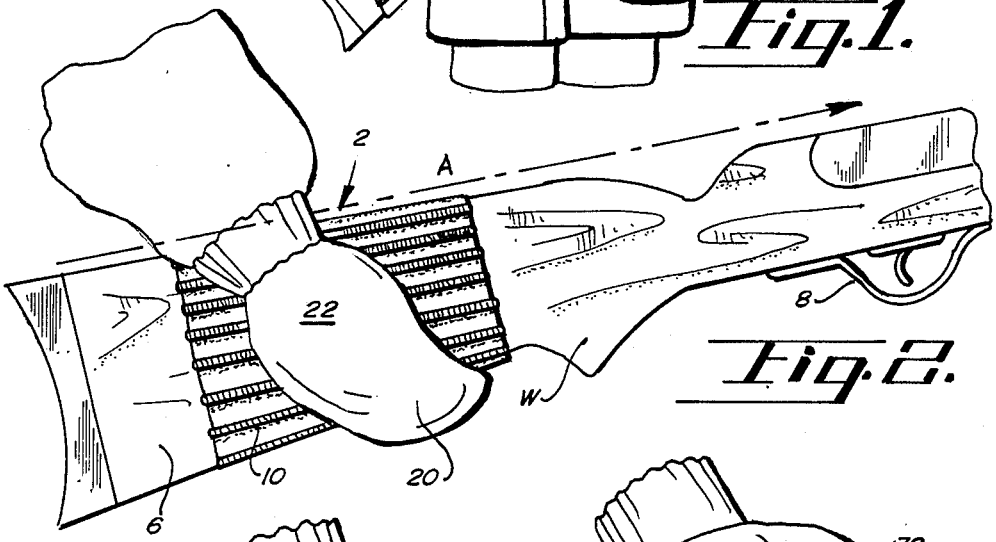
FIG. 2 is a side elevational view of the gun stock mitten of the present invention.

FIG. 1 shows generally and illustratively the hand protection or gun stock sleeve with mitten 2 of the present invention in use by a person carrying a weapon W in a "port-arms" position. FIG. 2 shows a closer view of the gun stock mitten 2 in use on a portion of gun W having a stock 6 and trigger/trigger guard assembly 8.

Figure 4:
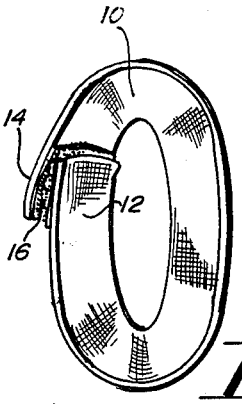
FIG. 4 is an end view of the stock sleeve shown in FIG. 3.
Figure 3:
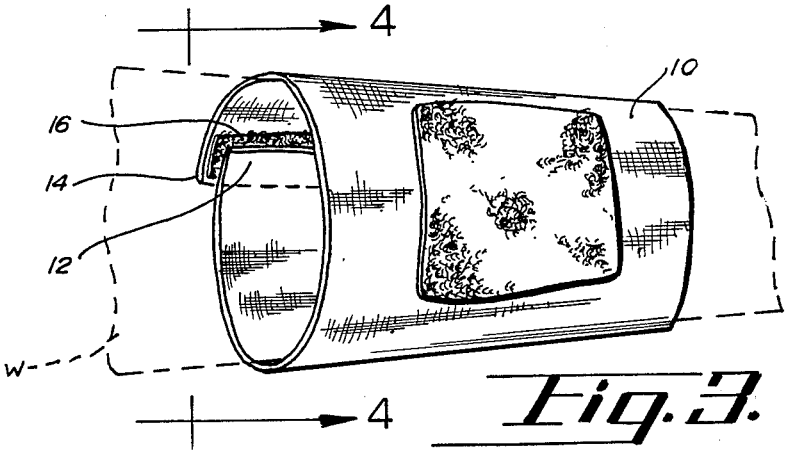
FIG. 3 is a perspective view of the stock sleeve of the present invention.
Figure 9:
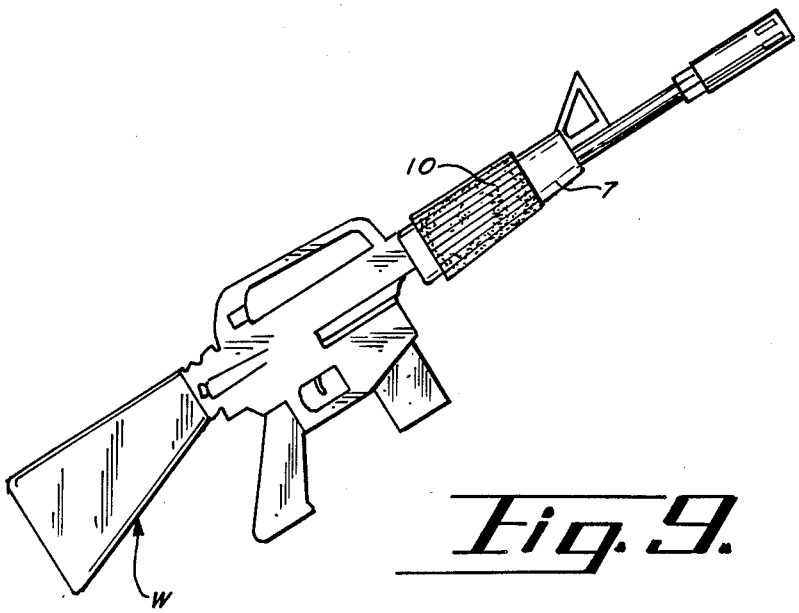
FIG. 9 is an elevational view of the stock sleeve of the present invention in use on the fore-end of a weapon.

FIGS. 2, 3 and 4 show additional detail related to the gun stock band or sleeve 10 of the present invention. The sleeve has first end 12 and second end 14 and is generally rectangular having a length greater than its width. It is not beyond the scope of the present invention that the sleeve may be of any desired shape as long as at least a portion of it completely encircles a portion of the shoulder stock 6 of a gun W when secured in place. A mitten holding pad 11 is attached to the sleeve, the holding pad 11 is permanently fixed to the sleeve and is made of a Velcro® or like material. For tightly securing the sleeve 10 in place, the first and second ends 12, 14 are provided with a Velcro® or like material area or portion 16. The portion is brought into contact at ends 12, 14 and thereby secures the sleeve in place around the stock of the gun. Because ends 12 and 14 overlap, the sleeve may be used with a variety of guns having varying stock sizes. Also with reference to FIG. 2, it will be noted that when in place, the sleeve 10 will not interfere with a user's line of sight because the sleeve tightly encircles and generally conforms to the stock. Line of sighting is depicted in FIG. 2 as line A. FIG. 9 shows that the sleeve 10 may be used on the fore-end 7 of a gun W.

Figure 5:
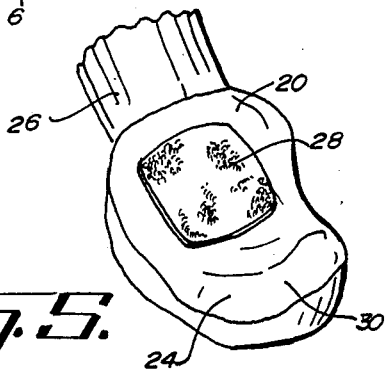
FIG. 5 is an elevational view of the mitten.
Figure 8:
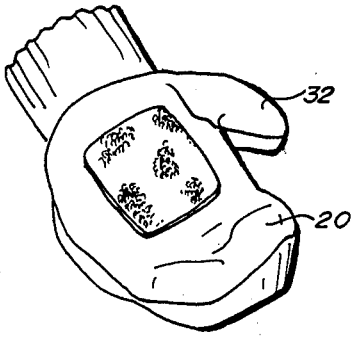
FIG. 8 is an electional view of an alternative embodiment of the mitten of the present invention.

The hand covering or mitten 20 of the present invention is seen in FIGS. 2, 5 and 8. The mitten has back side 22, palm side 24 and is equipped with wrist band 26. The palm side of the mitten is provided with a Velcro® like fabric grip pad or area 28. This area may be limited to the palm area of the hand covering, it may be extended to include the outermost end or finger covering area 30 of the hand covering or the entire exterior surface of the mitten may be an interactive material. Grip pad 28 cooperatively interacts with the mitten holding pad 11 on the sleeve 10 to removably attach the mitten 20 to the sleeve 10. The mitten 20 may be formed of any suitable weatherproof materials, examples may include leather, Gor-tex®, or synthetic fabrics. In use, a hunter or person carrying a gun in cold weather places the sleeve 10 about the shoulder stock 6 and/or the fore-end 7 of the gun and wears the mitten 20 at least on the hand that will be used to operate the trigger. As shown in FIGS. 1 and 5, the hand that operates the trigger normally grips the gun stock when carrying the gun. Because the sleeve 10 and mitten 20 are provided with a Velcro® or like interlocking material, after gripping the gun stock where the sleeve encircles it, the mitten 20 will be held or removable attached to the sleeve 10 and, thus, to the gun stock. When the user wants to fire the gun, he may quickly and easily slide the trigger hand out of the mitten 20, which will remain secured to the sleeve 10 and stock, and without interference or aid from the other hand to grasp the trigger and sight and fire the gun. When done firing, the trigger hand may conveniently be slipped back into the mitten 20 for continuing to carry the gun.

Figure 6:
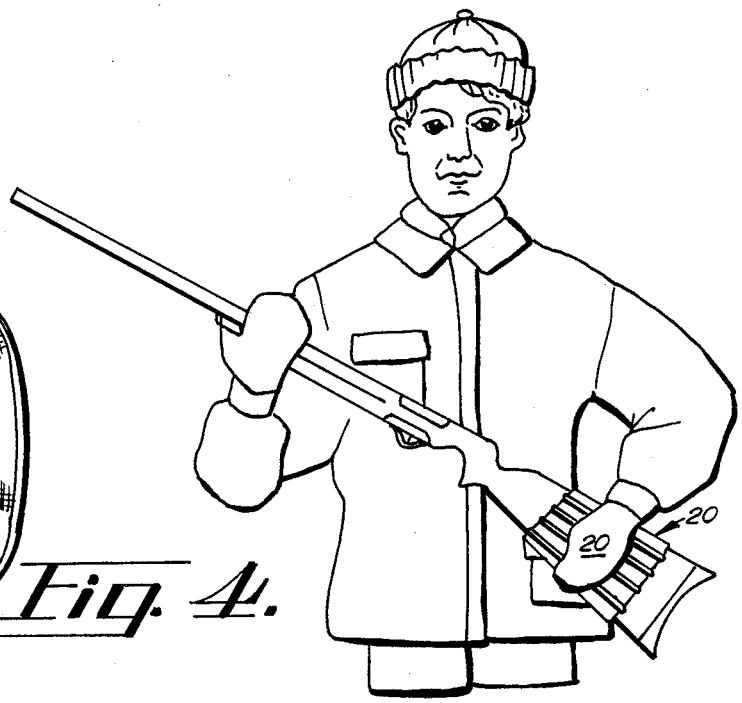
FIG. 6 is a pictorial view of a left-handed individual using the gun stock sleeve with mitten and carrying a weapon at "port-arms"

An advantage of the gun stock sleeve and mitten 2 of the present invention is shown by comparing FIGS. 1 and 6. That is, the gun stock mitten 2 is adapted for use by left-handed persons, shown in FIG. 6, without requiring any modification structurally. The left-handed person simply wears the mitten or hand covering 20 on the left hand rather than the right hand as a right-handed person would do.

Figure 7:
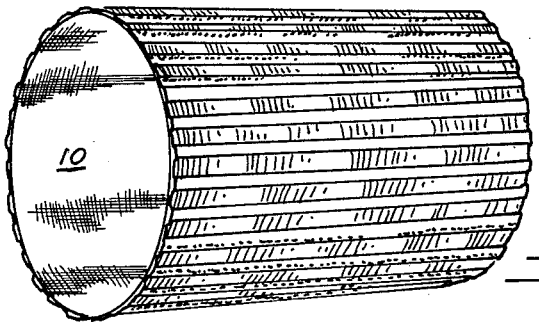
FIG. 7 is a perspective view of an alternative embodiment of the stock band or sleeve of the present invention.

Alternative embodiments of the present invention are shown in FIGS. 7 and 8. FIG. 7 shows that the gun stock band or sleeve 10 may be a continuous band or sleeve having a generally frusto-connical configuration. The sleeve depicted in FIG. 7 may be made from any suitable elastic material as long as the selected material has some hook and loop like releasably interlocking material for interlocking with mitten 20. FIG. 8 shows that the hand mitten 20 may be provided with a secondary interior or thumb receiving portion 32. It should be understood that the hand covering component of the present invention may also take the shape of a glove. Additionally, the hand covering may be permanently attached to the sleeve as by sewing, or removably attached to the sleeve by an interlocking snap method.

While the present invention has been described with reference to the best mode and illustrated embodiments, this description is not to be construed in a limiting sense. Other embodiments or modifications of the described embodiments may be apparent to persons skilled in the art. It is therefore to be understood that the appended claims will cover any such modifications or embodiments as are within the true scope of the invention.

I claim:

1. A gun stock sleeve with mitten for a right or left handed person carrying a shotgun, rifle, firearm or gun having a shoulder stock and a fore-end handgrip while in adverse weather conditions, comprising:
   (a) an adjustable gun stock sleeve for fitting about and encircling multiple places on a gun, one place comprising the shoulder stock and another comprising the fore-end hand grip;
   (b) a mitten for covering said person's left or right trigger hand; and
   (c) means for quickly releasably attaching the mitten to the sleeve in a wearer selected location and orientation so that the covered trigger hand may hold and carry the gun in any selected orientation while yet permitting quick withdrawal of the hand from the mitten without assistance of the person's other hand and grasping the trigger, sighting and shooting the gun without interference by the gun stock mitten and sleeve.

2. The gun stock sleeve with mitten of claim 1, wherein said sleeve has two ends and is formed of an elastic material for tightly fitting about the gun shoulder stock, said sleeve having securing means at the ends for securing the sleeve about the gun stock, said securing means comprising complementary releasably interlocking fabric areas.

3. The gun stock sleeve with mitten of claim 1, wherein said sleeve is an elastic material, said sleeve having means for attaching the mitten to the sleeve, said means comprising releasably interlocking fabric.

4. The gun stock sleeve with mitten of claim 1, wherein said sleeve is a non-elastic material, said sleeve having securing means for securing the sleeve about the gun stock, said securing means comprising releasably interlocking fabric.

5. The gun stock sleeve with mitten of claim 1, wherein said sleeve has two ends and is formed of an elastic material for tightly fitting about the fore-end of a gun, said sleeve having securing means at the ends for securing the sleeve about the fore-end, said means comprising complimentary releasably interlocking fabric areas.

6. A gun stock sleeve with mitten for a right or left handed person carrying a shotgun, rifle, firearm or gun having a shoulder stock and a fore-end handgrip while in adverse weather conditions, comprising:

(a) a continuous elastic gun stock sleeve for fitting about a portion of said shoulder stock;

(b) a mitten for covering said person's left or right trigger hand; and (c) means for quickly releasably attaching the mitten to the sleeve in a wearer selected location and orientation so that the covered trigger hand may hold and carry the gun in any selected orientation while yet permitting quick withdrawal of the hand from the mitten without assistance of the person's other hand and grasping the trigger, sighting and shooting the gun without interference by the gun stock mitten and sleeve.

7. Hand protection for the trigger hand of a right or left handed person carrying a shotgun, rifle, firearm or gun having a gun stock comprising a shoulder stock and a fore-end handgrip while in adverse weather conditions, said hand protection comprising:

(a) an adjustable gun stock sleeve for fitting about a portion of said shoulder stock, said sleeve having two ends and being formed of an elastic material, said sleeve ends having securing means for securing the sleeve tightly about the shoulder stock, said securing means comprising complementary releasably interlocking fabric, and wherein the length of the sleeve from end to end is greater than the outside dimension of the portion of the shoulder stock about which it is placed so that the ends overlap when the sleeve is encircling a portion of the shoulder stock, the overlapping ends and the sleeve elasticity thereby ensuring that the sleeve fits tightly about the shoulder stock to minimize interference with sighting and firing the gun;

(b) a mitten for covering the hand and fingers of a person's left or right trigger hand, said mitten having a back side, a palm side and a wrist band, the palm side of the mitten having a grip pad thereon; and (c) means for releasably attaching the mitten to the sleeve in any selected location and orientation thereon so that the person's trigger hand in the mitten may hold and carry the gun in any selected orientation while yet permitting the quick withdrawal of the person's hand, grasping the trigger, sighting and shooting the gun and setting the gun down without interference by the hand protection and without resorting to additional other hand coverings carried by the person to continue to protect the hands, said means comprising a mitten holding pad affixed to said sleeve and the grip pad on said palm side of said mitten, said mitten holding pad and grip pad being comprised of complementary releasably interlocking fabric.

* * * * *